US006417813B1

(12) United States Patent
Durham

(10) Patent No.: US 6,417,813 B1
(45) Date of Patent: Jul. 9, 2002

(54) FEEDTHROUGH LENS ANTENNA AND ASSOCIATED METHODS

(75) Inventor: Timothy Earl Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/919,449

(22) Filed: Jul. 31, 2001

Related U.S. Application Data

(63) Continuation-in-part of application No. 09/703,247, filed on Oct. 31, 2000.

(51) Int. Cl.[7] ..... H01Q 1/38; H01Q 15/02
(52) U.S. Cl. ..... 343/753; 343/795; 343/797
(58) Field of Search ..... 343/753, 754, 343/812, 814–817, 853, 795, 797; H01Q 21/00, 21/26, 21/28, 21/12, 15/02, 15/12

(56) References Cited

U.S. PATENT DOCUMENTS 3,995,277 A 11/1976 Olyphant, Jr. ..... 343/846
4,173,019 A 10/1979 Williams ..... 343/700
5,053,785 A * 10/1991 Tilston et al. ..... 343/797
5,485,167 A 1/1996 Wong et al. ..... 343/753

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

A feedthrough lens antenna includes first and second phased array antennas and a coupling structure connecting the first and second phased array antennas. Each phased array antenna may include a substrate and an array of dipole antenna elements on the substrate. Moreover, each dipole antenna element may include a medial feed portion and a pair of legs extending outwardly therefrom. Additionally, adjacent legs of the adjacent dipole antenna elements may include respective spaced apart end portions having predetermined shapes and relative positioning to provide increased capacitive coupling between the adjacent dipole antenna elements.

39 Claims, 7 Drawing Sheets

FEEDTHROUGH LENS ANTENNA AND ASSOCIATED METHODS

RELATED APPLICATION

The present application is a continuation-in-part of U.S. application Ser. No. 09/703,247, filed Oct. 31, 2000.

FIELD OF THE INVENTION

The present invention relates to the field of communications, and more particularly, to feedthrough lens antennas.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beam width is desirable. Also, the use of an array of microstrip patches can improve directivity by providing a predetermined scan angle. However, utilizing An array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwith of a phased array antenna with a wide scan angle is conventionally achieved by dividing the frequency range into multiple bands.

One example of such an antenna is disclosed in U.S. Pat. No. 5,485,167 to Wong et al. This antenna includes several pairs of dipole pair arrays each tuned to a different frequency band and stacked relative to each other along the transmission/reception direction. The highest frequency array is in front of the next lowest frequency array and so forth.

This approach may result in a considerable increase in the size and weight of the antenna while creating a Radio Frequency (RF) interface problem. Another approach is to use gimbals to mechanically obtain the required scan angle. Yet, here again, this approach may increase the size and weight of the antenna and result in a slower response time.

Thus, there is a need for a lightweight phased array antenna with a wide frequency bandwidth and a wide scan angle, and that is conformally mountable to a surface. Moreover, there is also a need for feedthrough lens antennas having such characteristics. Feedthrough lens antennas may be used in a variety of applications where it is desired to replicate an electromagnetic (EM) environment present on the outside of a structure within the structure over a particular bandwidth. For example, a feedthrough lens may be used to replicate signals, such as cellular telephone signals, within a building or airplane which may otherwise be reflected thereby. Furthermore, a feedthrough lens antenna may be used to provide a highpass filter response characteristic, which may be particularly advantageous for applications where very wide bandwidth is desirable.

An example of such a feedthrough lens antenna is disclosed in the above patent to Wong et al. The feedthrough lens structure disclosed in this patent includes several of the multiple layered phased array antennas discussed above. Yet, the above noted limitations will correspondingly be present when such antennas are used in feedthrough lens antennas.

SUMMARY OF THE INVENTION

In view of the foregoing background, it is therefore an object of the invention to provide a feedthrough lens antenna having a wide bandwidth and a wide scan angle.

This and other objects, features and advantages in accordance with the present invention are provided by a feedthrough lens antenna including first and second phased array antennas and a coupling structure connecting the first and second phased array antennas together in back-to-back relation. Each phased array antenna may include a substrate and an array of dipole antenna elements thereon. Each dipole antenna element may include a medial feed portion and a pair of legs extending outwardly therefrom. Additionally, adjacent legs of the adjacent dipole antenna elements may include respective spaced apart end portions having predetermined shapes and relative positioning to provide increased capacitive coupling between the adjacent dipole antenna elements.

More specifically, the coupling structure may include a ground plane. Each phased array antenna may have a desired frequency range, and the ground plane may be spaced from each array of dipole antenna elements less than about one-half a wavelength of a highest desired frequency. The coupling structure may also include a plurality of transmission elements each connecting a corresponding dipole antenna element of the first phased array antenna with a dipole antenna element of the second phased array antenna. The plurality of transmission elements may be coaxial cables, for example.

The feedthrough lens antenna may also include at least one dielectric layer on each array of dipole antenna elements. Each leg may include an elongated body portion and an enlarged width end portion connected to an end of the elongated body portion. Additionally, the spaced apart end portions in adjacent legs may include interdigitated portions. More particularly, each leg may include an elongated body portion, an enlarged width end portion connected to an end of the elongated body portion, and a plurality of fingers extending outwardly from the enlarged width end portion.

Additionally, each phased array antenna may have a desired frequency range, and the spacing between the end portions of adjacent legs may be less than about one-half a wavelength of a highest desired frequency. Each array of dipole antenna elements may include first and second sets of orthogonal dipole antenna elements to provide dual polarization. The elements of each array of dipole antenna elements may also be sized and relatively positioned so that each phased array antenna is operable over a frequency range of about 2 to 30 GHz, for example. Further, the elements of each array of dipole antenna elements may be sized and relatively positioned so that each phased array antenna is operable over a scan angle of about ±60 degrees, for example.

A method aspect of the present invention is for making a feedthrough lens antenna. The method may include providing first and second substrates, forming an array of dipole antenna elements on each of the first and second substrates to define first and second phased array antennas, and connecting the first and second phased array antennas together in back-to-back relation. Each dipole antenna element may include a medial feed portion and a pair of legs extending outwardly therefrom. Respective spaced apart end portions of adjacent legs of adjacent dipole antenna elements may also be positioned and shaped to provide increased capacitive coupling between the adjacent dipole antenna elements.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
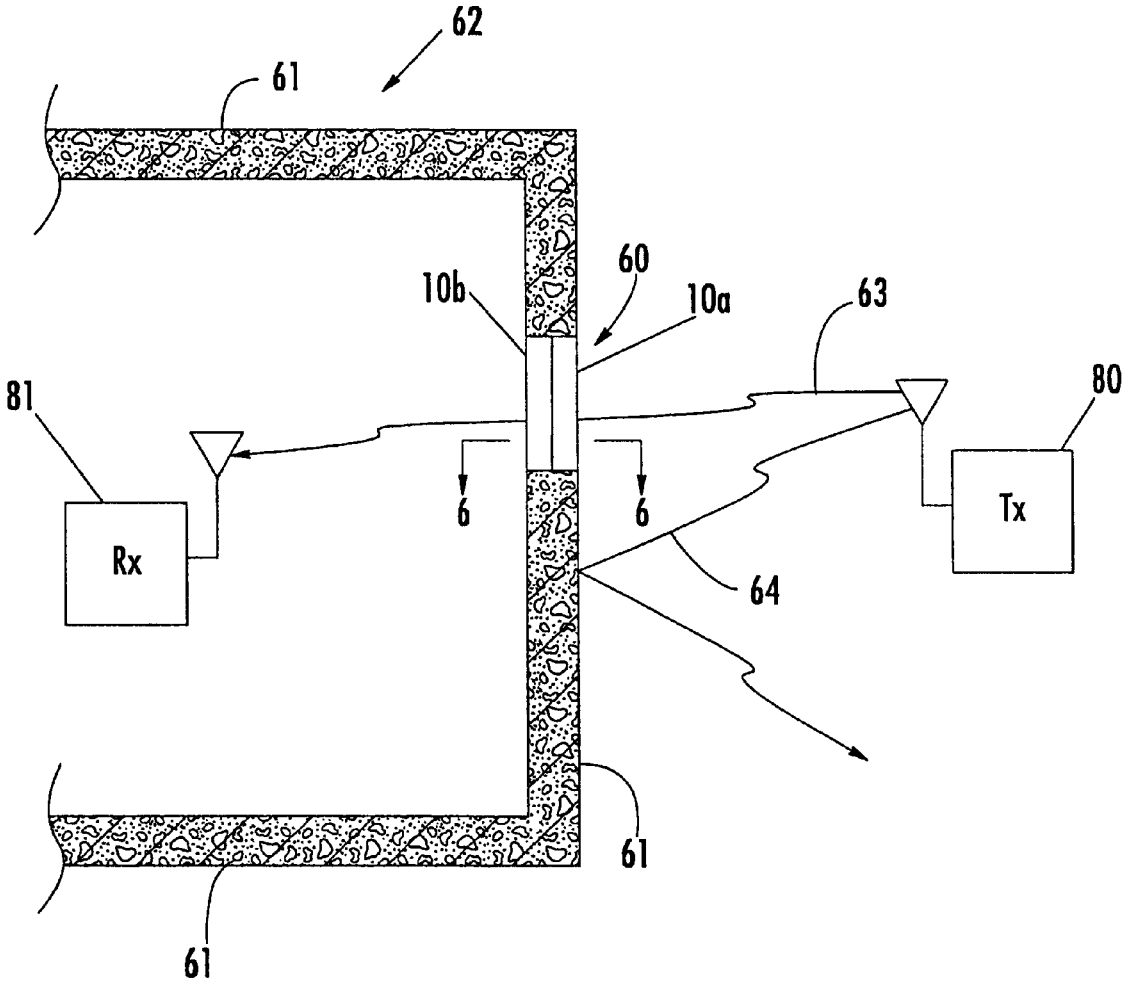
FIG. 1 is top plan view of a building partly in sectional illustrating a feedthrough lens antenna according to the present invention positioned in a wall of the building.

Referring initially to FIG. 1, a feedthrough lens antenna 60 according to the invention is first described. As noted above, feedthrough lens antennas may be used in a variety of applications where it is desired to replicate an EM environment within a structure, such as the building 62, over a particular bandwidth. For example, the feedthrough lens antenna 60 may be positioned on a wall 61 of the building 62. As illustratively shown in FIG. 1, the feedthrough lens antenna 60 allows EM signals 63 from a transmitter 80 (e.g., a cellular telephone base station) to be replicated on the interior of the building 62 and received by a receiver 81 (e.g., a cellular telephone). Otherwise, a similar signal 64 may be partially or completely reflected by the walls 61.

The feedthrough lens antenna 60 may include first and second phased array antennas 10*a*, 10*b*, which are preferably substantially identical. Accordingly, for clarity of explanation, a single phased array antenna 10 according to the invention will first be described with reference to FIGS. 2–5, and the feedthrough lens antenna 60 will be further described thereafter.

Figure 2:
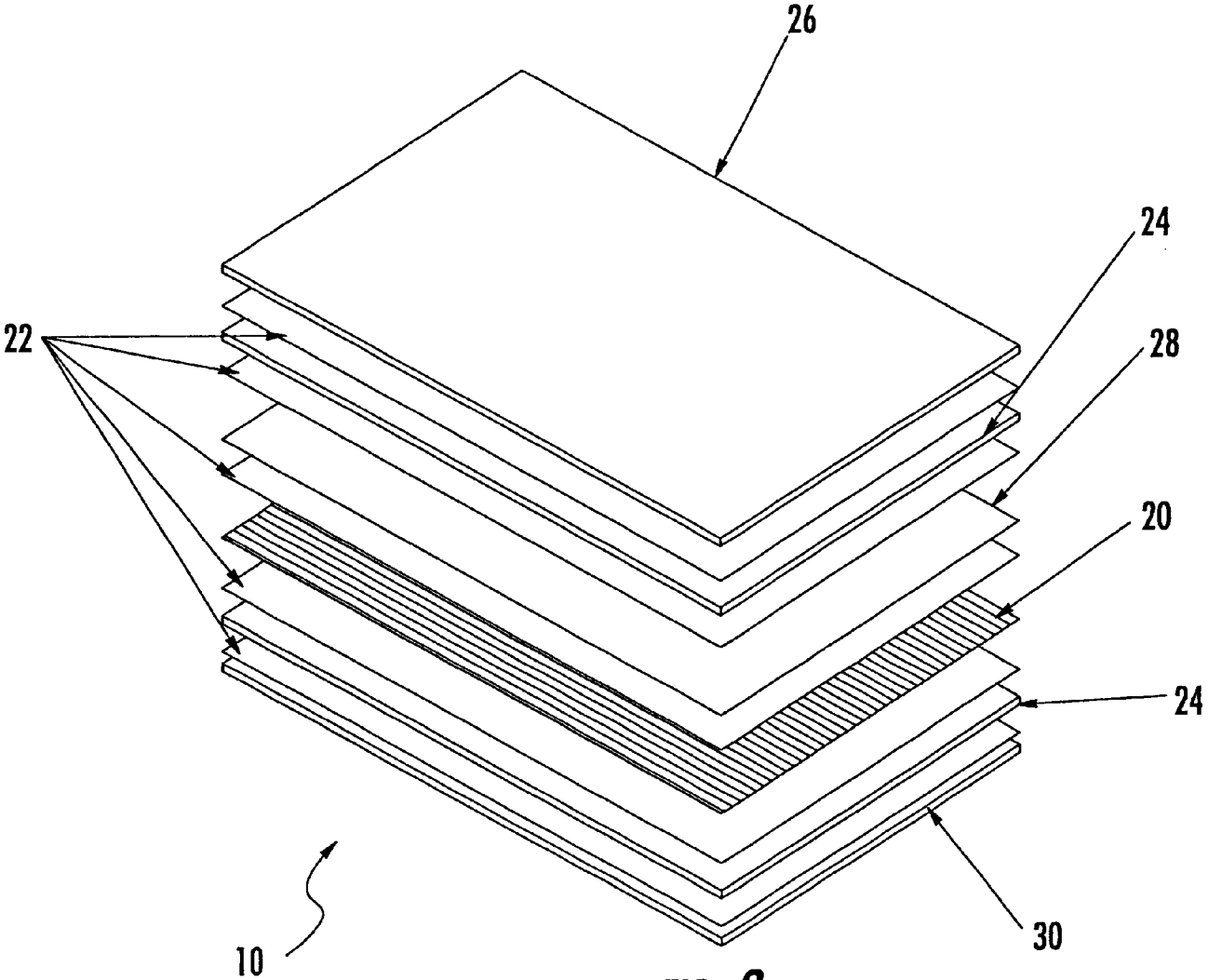
FIG. 2 is an exploded view of a wideband phased array antenna of the feedthrough lens antenna of FIG. 1.

The wideband phased array antenna 10 is preferably formed of a plurality of flexible layers, as shown in FIG. 2. These layers include a dipole layer 20 or current sheet which is sandwiched between a ground plane 30 and a cap layer 28. Additionally, dielectric layers of foam 24 and an outer dielectric layer of foam 26 are provided. Respective adhesive layers 22 secure the dipole layer 20, ground plane 30, cap layer 28, and dielectric layers of foam 24, 26 together to form the flexible and conformal antenna 10. Of course other ways of securing the layers may also be used as would be appreciated by the skilled artisan.

The dielectric layers 24, 26 may have tapered dielectric constants to improve the scan angle. For example, the dielectric layer 24 between the ground plane 30 and the dipole layer 20 may have a dielectric constant of 3.0, the dielectric layer 24 on the opposite side of the dipole layer 20 may have a dielectric constant of 1.7, and the outer dielectric layer 26 may have a dielectric constant of 1.2.

Figure 3:
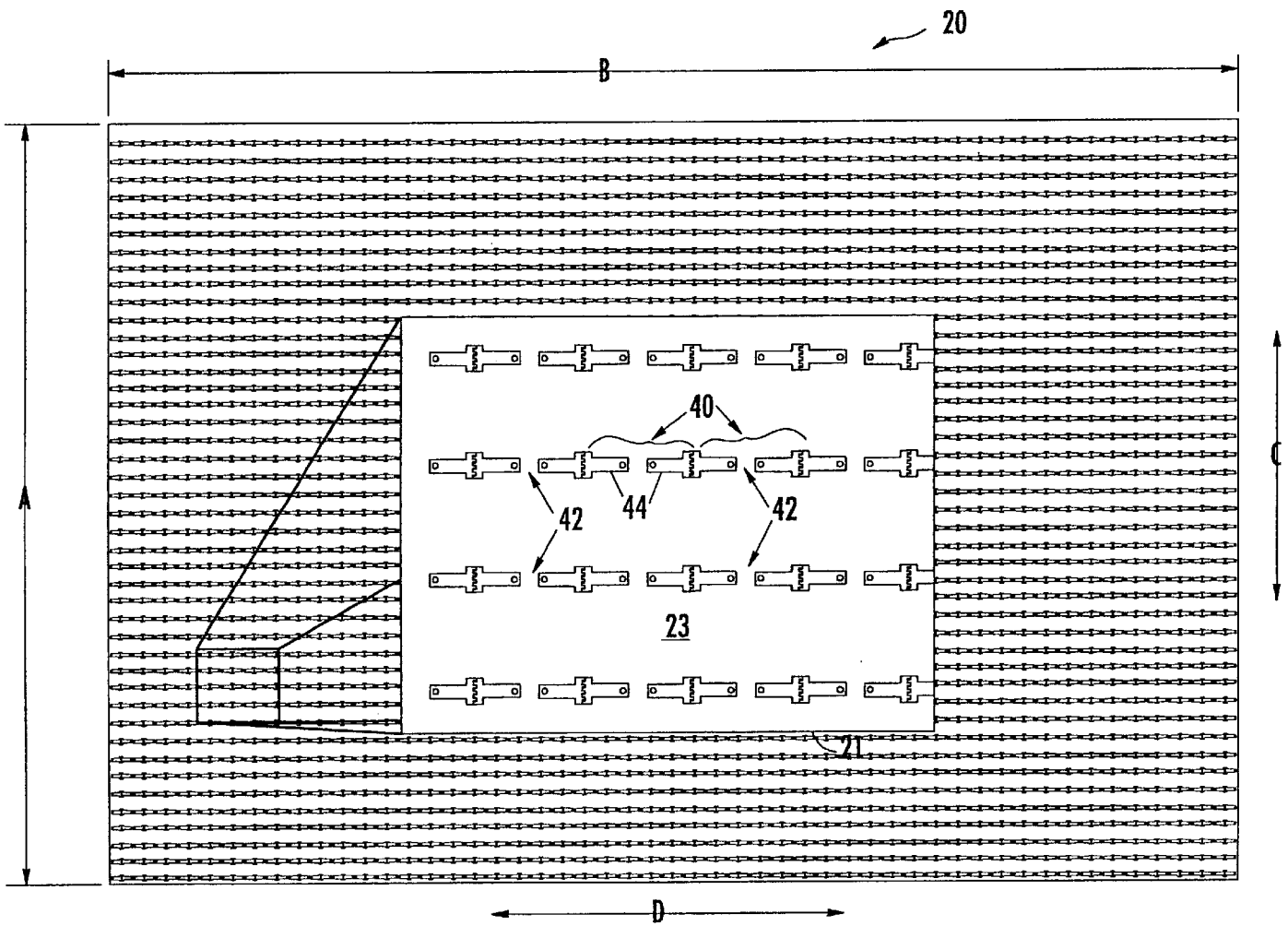
FIG. 3 is a schematic diagram of the printed conductive layer of the wideband phased array antenna of FIG. 2.
Figure 4A:
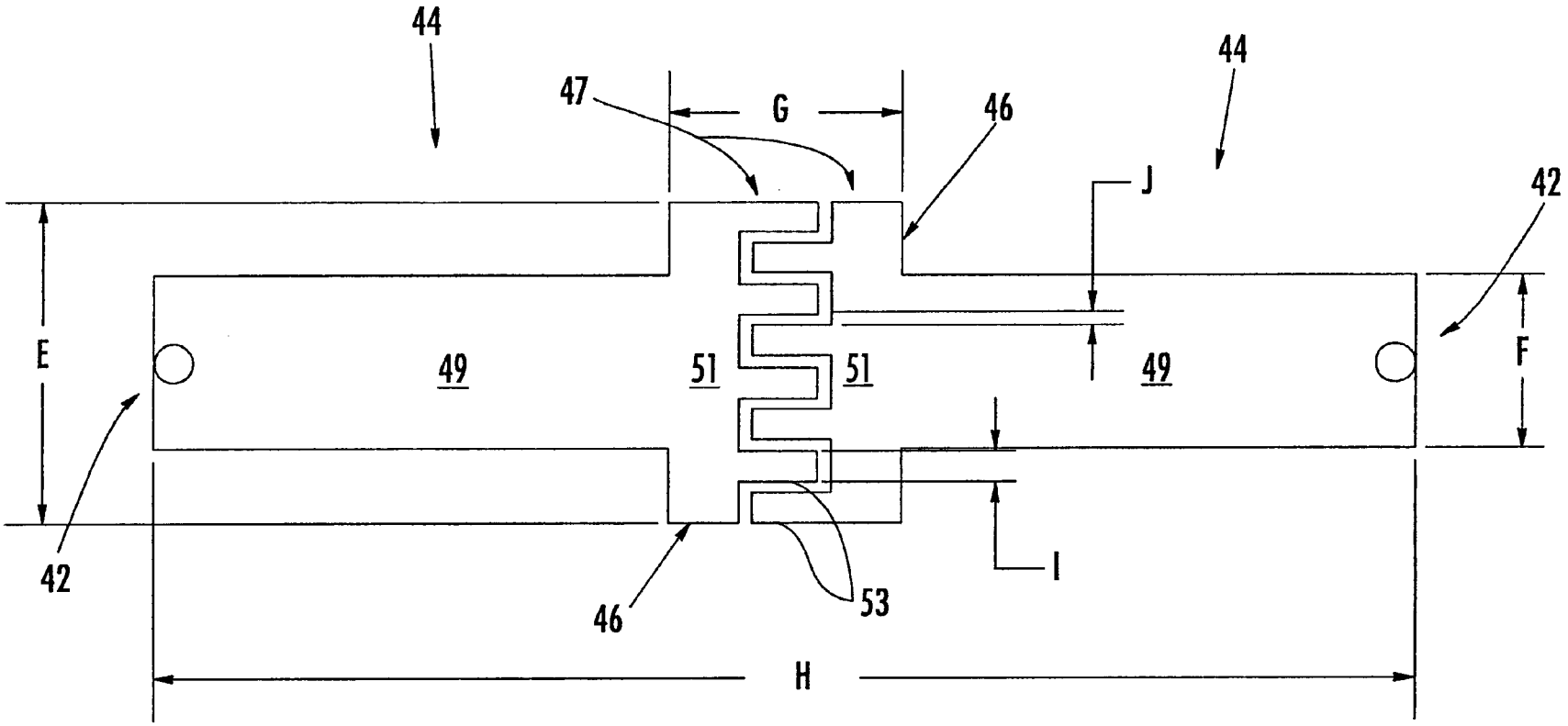
FIGS. 4A and 4B are enlarged schematic views of the spaced apart end portions of adjacent legs of adjacent dipole antenna elements of the wideband phased array antenna of FIG. 2.
Figure 4B:
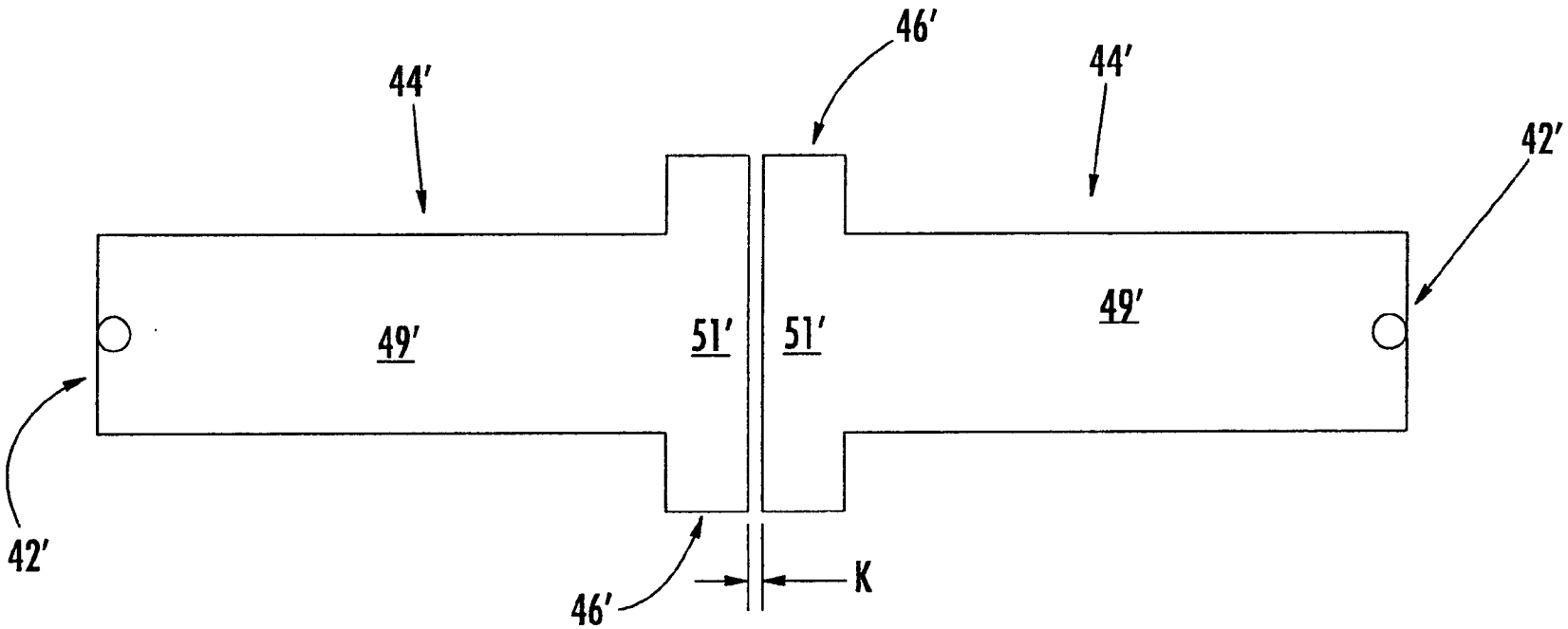

Referring now to FIGS. 3, 4A and 4B, a first embodiment of the dipole layer 20 will now be described. The dipole layer 20 is a printed conductive layer having an array of dipole antenna elements 40 on a flexible substrate 23. Each dipole antenna element 40 comprises a medial feed portion 42 and a pair of legs 44 extending outwardly therefrom. Respective feed lines are connected to each feed portion 42 from the opposite side of the substrate 23, as will be described in greater detail below. Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 may be between about 0.016 and 0.636 picofarads (pF), and preferably between 0.159 and 0.239 pF.

Preferably, as shown in FIG. 4A, the spaced apart end portions 46 in adjacent legs 44 have overlapping or interdigitated portions 47, and each leg 44 comprises an elongated body portion 49, an enlarged width end portion 51 connected to an end of the elongated body portion, and a plurality of fingers 53, e.g. four, extending outwardly from the enlarged width end portion.

Alternatively, as shown in FIG. 4B, adjacent legs 44' of adjacent dipole antenna elements 40 may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitive coupling between the adjacent dipole antenna elements. Here, for example, the distance K between the spaced apart end portions 46' is about 0.003 inches. Of course, other arrangements which increase the capacitive coupling between the adjacent dipole antenna elements are also contemplated by the present invention.

Preferably, the array of dipole antenna elements 40 are arranged at a density in a range of about 100 to 900 per square foot. The array of dipole antenna elements 40 are sized and relatively positioned so that the wideband phased array antenna 10 is operable over a frequency range of about 2 to 30 GHz, and at a scan angle of about ±60 degrees (low scan loss). Such an antenna 10 may also have a 10:1 or greater bandwidth, includes conformal surface mounting, while being relatively lightweight, and easy to manufacture at a low cost.

For example, FIG. 4A is a greatly enlarged view showing adjacent legs 44 of adjacent dipole antenna elements 40 having respective spaced apart end portions 46 to provide the increased capacitive coupling between the adjacent dipole antenna elements. In the example, the adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches. In the example (referring to FIG. 3), the dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements.

The wideband phased array antenna 10 has a desired frequency range, e.g. 2 GHz to 18 GHz, and the spacing between the end portions 46 of adjacent legs 44 is less than about one-half a wavelength of a highest desired frequency.

Figure 5:
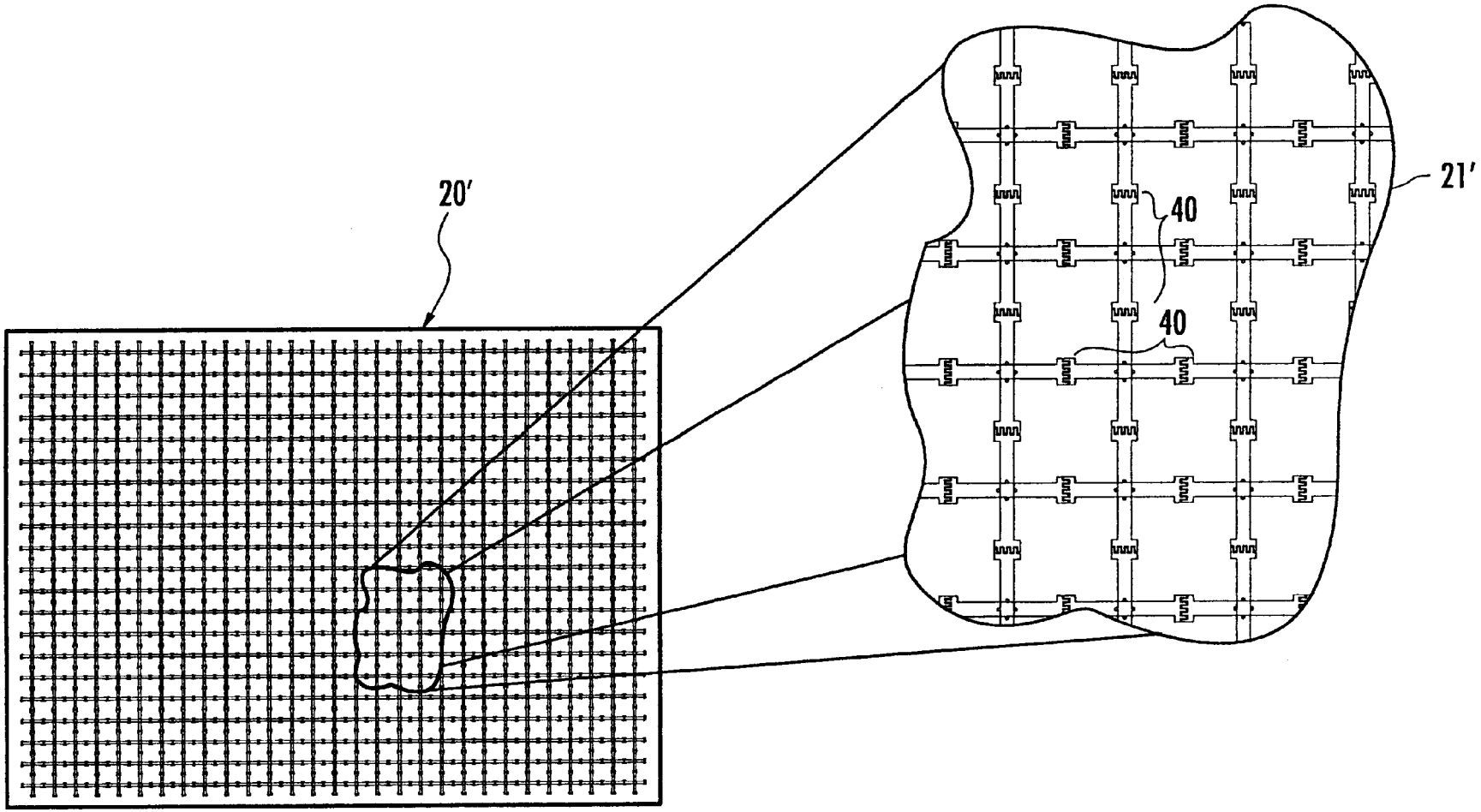
FIG. 5 is a schematic diagram of the printed conductive layer of the wideband phased array antenna of another embodiment of the wideband phased array antenna of FIG. 2.

Referring to FIG. 5, another embodiment of the dipole layer 20' may include first and second sets of dipole antenna elements 40 which are orthogonal to each other to provide dual polarization, as would be appreciated by the skilled artisan.

The phased array antenna 10 may be made by forming the array of dipole antenna elements 40 on the flexible substrate 23. This preferably includes printing and/or etching a conductive layer of dipole antenna elements 40 on the substrate 23. As shown in FIG. 5, first and second sets of dipole antenna elements 40 may be formed orthogonal to each other to provide dual polarization.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 preferably includes forming interdigitated portions 47 (FIG. 4A) or enlarged width end portions 51' (FIG. 4B). A ground plane 30 is preferably formed adjacent the array of dipole antenna elements 40, and one or more dielectric layers 24, 26 are layered on both sides of the dipole layer 20 with adhesive layers 22 therebetween.

Forming the array of dipole antenna elements 40 may further include forming each leg 44 with an elongated body portion 49, an enlarged width end portion 51 connected to an end of the elongated body portion, and a plurality of fingers 53 extending outwardly from the enlarged width end portion. Again, the wideband phased array antenna 10 has a desired frequency range, and the spacing between the end portions 46 of adjacent legs 44 is less than about one-half a wavelength of a highest desired frequency. The ground plane 30 is spaced from the array of dipole antenna elements 40 less than about one-half a wavelength of the highest desired frequency.

As discussed above, the array of dipole antenna elements 40 are preferably sized and relatively positioned so that the wideband phased array antenna 10 is operable over a frequency range of about 2 to 30 GHz, and operable over a scan angle of about ±60 degrees. The antenna 10 may also be mounted on a rigid mounting member 12 having a non-planar three-dimensional shape, such as an aircraft, for example.

Thus, a phased array antenna 10 with a wide frequency bandwith and a wide scan angle is obtained by utilizing tightly packed dipole antenna elements 40 with large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth. The antenna 10 is scannable with a beam former, and each antenna dipole element 40 has a wide beam width. The layout of the elements 40 could be adjusted on the flexible substrate 23 or printed circuit board, or the bean former may be used to adjust the path lengths of the elements to put them in phase.

Figure 6:
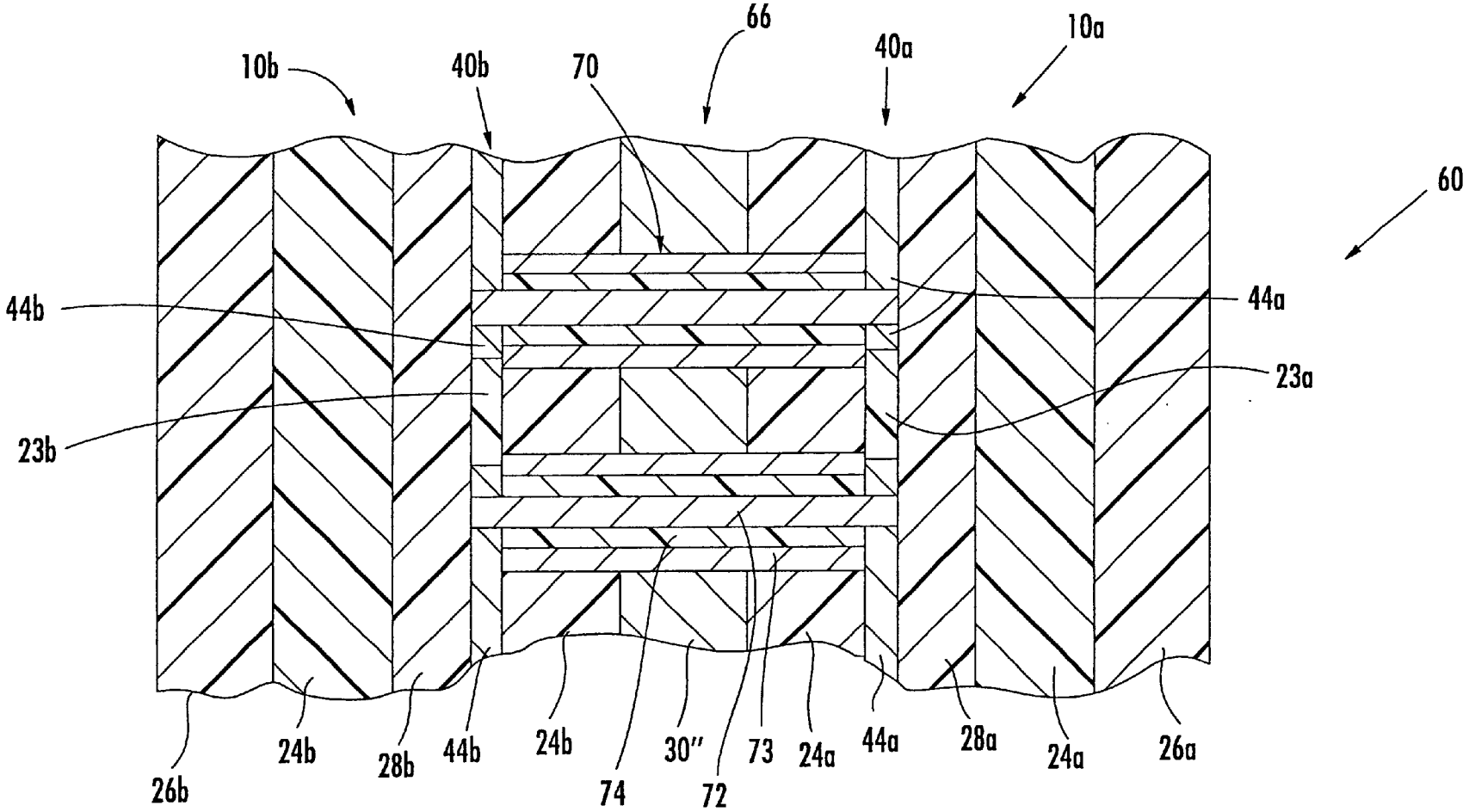
FIG. 6 is a cross sectional view of the feedthrough lens antenna of FIG. 1 taken along line 6—6.

Turning now to FIG. 6, the feedthrough lens antenna 60 will now be further described. As noted above, the feedthrough lens antenna 60 may include first and second phased array antennas 10*a*, 10*b*. More specifically, the first and second phased array antennas 10*a*, 10*b* are connected by a coupling structure 66 in back-to-back relation. Again, the first and second phased array antennas 10*a*, 10*b* are substantially similar to the antenna 10 described above. Thus, for clarity of explanation, only the differences therebetween will be described below.

For example, the coupling structure 66 includes a single ground plane 30" which may serve as the ground plane for both of the first and second phased array antennas 10*a*, 10*b*, rather than each having individual ground planes as described above. Of course, the first and second phased array antennas 10*a*, 10*b* may each be formed with an individual ground plane 30 to be connected during assembly. In such case, circuit elements such as phase shifters, amplifiers, etc., for example, may be positioned between the two ground planes 30, as will be appreciated by those of skill in the art. Moreover, each phased array antenna 10*a*, 10*b* may have a desired frequency range, and the ground plane 30" may be spaced from each, array of dipole antenna elements 40*a*, 40*b* less than about one-half a wavelength of a highest desired frequency, as similarly described above.

The coupling structure 66 also includes a plurality of transmission elements 70 each connecting a corresponding dipole antenna element 40*a* of the first phased array antenna 10*a* with a dipole antenna element 40*b* of the second phased array antenna 10*b*. The transmission elements 70 may be coaxial cables, for example, as illustratively shown in FIG. 6, including an inner conductor 72, an outer conductor 73, and an intermediate dielectric layer 74 therebetween. Of course, parallel feed lines or other suitable connectors may also be used, as will be appreciated by those of skill in the art. The transmission elements 70 preferably extend through the ground plane 30".

By using the wide bandwidth phased array antenna 10 described above, the feedthrough lens antenna 60 of the present invention will advantageously have a transmission passband with a bandwidth on the same order. Similarly, the feedthrough lens antenna 60 will also have a substantially unlimited reflection band, since the phased array antenna 10 is substantially reflective at frequencies below its operating band. Scan compensation may also be achieved as described above. Additionally, the various layers of the first and second phased array antennas 10*a*, 10*b* may be flexible as described above, or they may be more rigid for use in applications where strength or stability may be necessary, as will be appreciated by those of skill in the art.

A related method aspect of the present invention is for making the feedthrough lens antenna 60. The method may include providing first and second substrates 23*a*, 23*b* and forming the array of dipole antenna elements 40*a*, 40*b* on each of the first and second substrates to define the first and second phased array antennas 10*a*, 10*b*, as previously described above. The first and second phased array antennas 10*a*, 10*b* may be connected together by connecting the ground plane 30" between the first and second phased array antennas 10*a*, 10*b*.

Also, each dipole antenna element 40*a* of the first phased array antenna 10*a* may be connected with a corresponding dipole antenna element 40*b* of the second phased array antenna 10*b*. For example, the respective dipole antenna elements 40*a*, 40*b* may be connected by the transmission elements 70 (e.g., coaxial cables) in back-to-back relation, as described above. The formation of the first and second phased array antennas 10*a*, 10*b* may otherwise be as described above.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A feedthrough lens antenna comprising:

first and second phased array antennas, each comprising a substrate and an array of dipole antenna elements thereon, each dipole antenna element comprising a medial feed portion and a pair of legs extending outwardly therefrom, adjacent legs of adjacent dipole antenna elements including respective spaced apart end portions having predetermined shapes and relative positioning to provide increased capacitive coupling between the adjacent dipole antenna elements; and a coupling structure connecting said first and second phased array antennas together in back-to-back relation.

2. The feedthrough lens antenna according to claim 1 wherein said coupling structure comprises a ground plane.

3. The feedthrough lens antenna according to claim 2 wherein each phased array antenna has a desired frequency range; and wherein said ground plane is spaced from each array of dipole antenna elements less than about one-half a wavelength of a highest desired frequency.

4. The feedthrough lens antenna according to claim 1 wherein said coupling structure further comprises a plurality of transmission elements each connecting a corresponding dipole antenna element of said first phased array antenna with a dipole antenna element of said second phased array antenna.

5. The feedthrough lens antenna according to claim 4 wherein said plurality of transmission elements comprise coaxial cables.

6. The feedthrough lens antenna according to claim 1 further comprising at least one dielectric layer on each array of dipole antenna elements.

7. The feedthrough lens antenna according to claim 1 wherein each leg comprises:

an elongated body portion; and an enlarged width end portion connected to an end of the elongated body portion.

8. The feedthrough lens antenna according to claim 1 wherein the spaced apart end portions in adjacent legs comprise interdigitated portions.

9. The feedthrough lens antenna according to claim 8 wherein each leg comprises an elongated body portion, an enlarged width end portion connected to an end of the elongated body portion, and a plurality of fingers extending outwardly from said enlarged width end portion.

10. The feedthrough lens antenna according to claim 1 wherein each phased array antenna has a desired frequency range; and wherein the spacing between the end portions of adjacent legs is less than about one-half a wavelength of a highest desired frequency.

11. The feedthrough lens antenna according to claim 1 wherein each array of dipole antenna elements comprises first and second sets of orthogonal dipole antenna elements to provide dual polarization.

12. The feedthrough lens antenna according to claim 1 wherein the elements of each array of dipole antenna elements are sized and relatively positioned so that each phased array antenna is operable over a frequency range of about 2 to 30 GHz.

13. The feedthrough lens antenna according to claim 1 wherein said dipole antenna elements are sized and relatively positioned so that each phased array antenna is operable over a scan angle of about ±60 degrees.

14. A feedthrough lens antenna comprising:

first and second phased array antennas each comprising an array of dipole antenna elements, each dipole antenna element comprising a medial feed portion and a pair of legs extending outwardly therefrom, adjacent legs of adjacent dipole antenna elements including respective spaced apart interdigitated end portions having predetermined shapes and relative positioning to provide increased capacitive coupling between the adjacent dipole antenna elements; and a coupling structure connecting said first and second phased array antennas together in back-to-back relation.

15. The feedthrough lens antenna according to claim 14 wherein said coupling structure comprises a ground plane.

16. The feedthrough lens antenna according to claim 15 wherein each phased array antenna has a desired frequency range; and wherein said ground plane is spaced from each array of dipole antenna elements less than about one-half a wavelength of a highest desired frequency.

17. The feedthrough lens antenna according to claim 14 wherein said coupling structure comprises a plurality of transmission elements each connecting a corresponding dipole antenna element of said first phased array antenna with a dipole antenna element of said second phased array antenna.

18. The feedthrough lens antenna according to claim 17 wherein said plurality of transmission elements comprise coaxial cables.

19. The feedthrough lens antenna according to claim 14 further comprising at least one dielectric layer on each array of dipole antenna elements.

20. The feedthrough lens antenna according to claim 14 wherein each leg comprises:

an elongated body portion; and an enlarged width end portion connected to an end of the elongated body portion.

21. The feedthrough lens antenna according to claim 14 wherein each of said first and second phased array antennas further comprises a substrate carrying said array of dipole antenna elements.

22. The feedthrough lens antenna according to claim 14 wherein each leg comprises an elongated body portion, an enlarged width end portion connected to an end of the elongated body portion, and a plurality of fingers extending outwardly from said enlarged width end portion.

23. The feedthrough lens antenna according to claim 14 wherein each phased array antenna has a desired frequency range; and wherein the spacing between the end portions of adjacent legs is less than about one-half a wavelength of a highest desired frequency.

24. The feedthrough lens antenna according to claim 14 wherein each array of dipole antenna elements comprises first and second sets of orthogonal dipole antenna elements to provide dual polarization.

25. The feedthrough lens antenna according to claim 14 wherein the elements of each array of dipole antenna elements are sized and relatively positioned so that each phased array antenna is operable over a frequency range of about 2 to 30 GHz.

26. The feedthrough lens antenna according to claim 14 wherein said dipole antenna elements are sized and relatively positioned so that each phased array antenna is operable over a scan angle of about ±60 degrees.

27. A method for making a feedthrough lens antenna comprising:

providing first and second substrates;

forming an array of dipole antenna elements on each of the first and second substrates to define first and second phased array antennas, each dipole antenna element comprising a medial feed portion and a pair of legs extending outwardly therefrom, and positioning and shaping respective spaced apart end portions of adjacent legs of adjacent dipole antenna elements to provide increased capacitive coupling between the adjacent dipole antenna elements; and connecting the first and second phased array antennas together in back-to-back relation.

28. The method according to claim 27 wherein connecting the first and second phased array antennas comprises connecting a ground plane between the first and second phased array antennas.

29. The method according to claim 28 wherein each phased array antenna has a desired frequency range; and wherein the ground plane is spaced from each array of dipole antenna elements less than about one-half a wavelength of a highest desired frequency.

30. The method according to claim 27 wherein connecting the first and second phased array antennas comprises connecting each dipole antenna element of the first phased array antenna with a corresponding dipole antenna element of the second phased array antenna.

31. The method according to claim 30 wherein connecting comprises connecting each dipole antenna element of the first phased array antenna with the corresponding dipole antenna element of the second phased array antenna using a coaxial cable.

32. The method according to claim 27 further comprising forming at least one dielectric layer on each array of dipole antenna elements.

33. The method according to claim 27 wherein forming each array of dipole elements comprises forming each leg with an elongated body portion, and an enlarged width end portion connected to an end of the elongated body portion.

34. The method according to claim 27 wherein shaping and positioning respective spaced apart end portions comprises forming interdigitated portions.

35. The method according to claim 34 wherein forming each array of dipole antenna elements comprises forming each leg with an elongated body portion, an enlarged width end portion connected to an end of the elongated body portion, and a plurality of fingers extending outwardly from the enlarged width end portion.

36. The method according to claim 27 wherein each phased array antenna has a desired frequency range; and wherein the spacing between the end portions of adjacent legs is less than about one-half a wavelength of a highest desired frequency.

37. The method according to claim 27 wherein forming each array of dipole antenna elements comprises forming first and second sets of orthogonal dipole antenna elements to provide dual polarization.

38. The method according to claim 27 wherein the elements of each array of dipole antenna elements are sized and relatively positioned so that each phased array antenna is operable over a frequency range of about 2 to 30 GHz.

39. The method according to claim 27 wherein the elements of each array of dipole antenna elements are sized and relatively positioned so that each phased array antenna is operable over a scan angle of about ±60 degrees.

* * * * *